United States Patent [19]

Jackson

[11] 4,030,264

[45] June 21, 1977

[54] WOOD RIVET AND METHOD OF INSTALLATION IN A TRUSS

[75] Inventor: Edgar D. Jackson, Alta Loma, Calif.

[73] Assignee: Steel Web Corporation, Alta Loma, Calif.

[22] Filed: Apr. 12, 1976

[21] Appl. No.: 675,977

[52] U.S. Cl. ..... 52/693; 29/512; 29/526

[51] Int. Cl.[2] ..... E04C 3/12; E04C 3/17

[58] Field of Search ..... 85/37, 39; 52/693, 694, 52/639; 29/512, 526

[56] References Cited

UNITED STATES PATENTS

| | | | |
|---|---|---|---|
| 1,984,350 | 12/1934 | Halsey et al. | 29/512 |
| 2,146,461 | 2/1939 | Bettington | 29/512 |
| 3,247,629 | 4/1966 | Behlen | 52/694 |

FOREIGN PATENTS OR APPLICATIONS

| | | | |
|---|---|---|---|
| 286,218 | 7/1915 | Germany | 52/694 |
| 857,139 | 11/1952 | Germany | 52/693 |
| 493,635 | 12/1938 | United Kingdom | 52/693 |
| 241,019 | 10/1925 | United Kingdom | 52/694 |

*Primary Examiner*—Price C. Faw, Jr.
*Assistant Examiner*—James L. Ridgill, Jr.
*Attorney, Agent, or Firm*—William W. Haefliger

[57] ABSTRACT

A metallic fastener connects metallic webs to a truss chord member. The fastener comprises a head overlying a pair of web ends and a tubular shank extending through openings in the web ends. The shank has a deformed, radially outwardly flaring end portion which compressively deforms the chord wood immediately surrounding the flare.

3 Claims, 5 Drawing Figures

WOOD RIVET AND METHOD OF INSTALLATION IN A TRUSS

BACKGROUND OF THE INVENTION

This invention relates generally to the construction of trusses adapted for use in mobile homes and similar environments. More specifically, the invention concerns simplification of the construction process and the formation of a superior product.

Prior to this invention, the process of truss construction required preliminary cutting of wooden reinforcement webs to size to be placed between and connected to wooden chord members. No way was known to employ lightweight tubular members as reinforcement between chord members, in the advantageous manner contemplated by the invention, and to achieve unusually beneficial results that include: high strength, simple construction; and the provision of web flat ends or tabs which may be overlapped and rapidly connected to chord members at their inner sides.

SUMMARY OF THE INVENTION

It is a major object of the invention to provide structure and method meeting the above needs and greatly simplifying and speeding the construction of trussed joists. Basically, the invention involves the use of:

a. metallic webs extending in zig-zag configuration in the space between wooden chord members, each web having opposite ends which are flat, the flat ends of successive webs extending in overlapping relation and containing aligned openings, and b. metallic fasteners attaching the overlapping ends of the webs to the chord members, each fastener comprising a head overlapping a single web end or two overlapping web ends, and a tubular shank extending through the web end opening and also through an opening formed in the adjacent chord members, the shank having a flaring end portion which compressively deforms the chord wood immediately surrounding the flare to lock the shank to the chord.

As will be seen, the flaring end portion of the shank terminates in substantially flush relation with the chord surface so that no protuberances appear at the underside of the truss to prevent flush attachment of panels to the truss.

It is another object of the invention to provide fastener or rivets for usage as described, and a method of truss construction as will appear.

These and other objects and advantages of the invention, as well as the details of an illustrative embodiment, will be more fully understood from the following description and drawings, in which:

DRAWING DESCRIPTION

DETAILED DESCRIPTION

Figure 1:
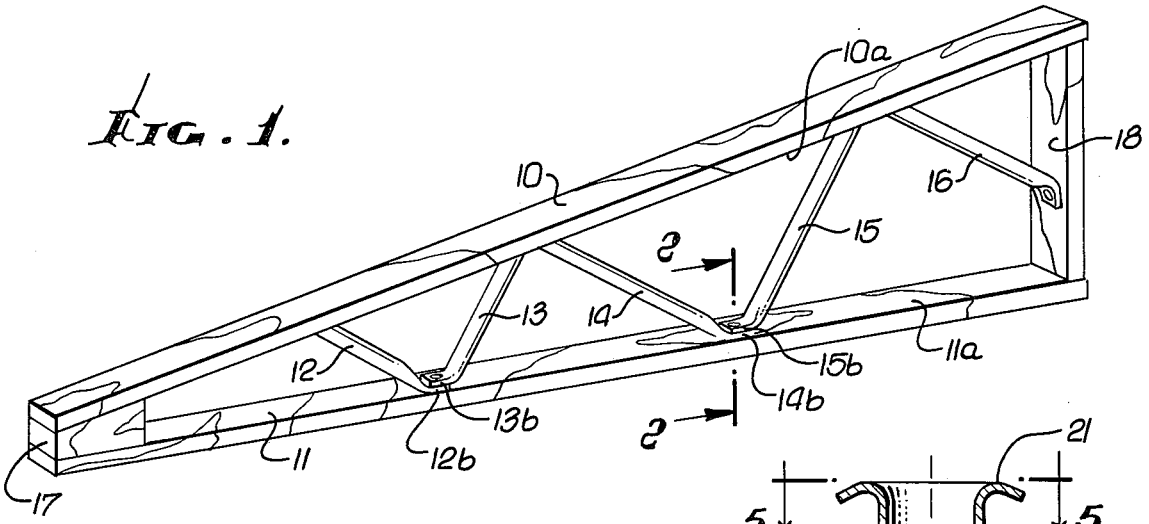
FIG. 1 is a perspective showing of a truss incorporating the invention.

FIG. 1 shows upper and lower longitudinally elongated chord members 10 and 11 extending in the same generally horizontal direction, and spaced apart vertically. Such members typically consist of wood, and may taper toward one another as shown.

Metallic tubular webs 12–16 extend in zig-zag configuration in the space between the chord members, certain webs being tension members, and other webs being compression members. Webs 12, 14 and 16 extend diagonally upwardly and longitudinally toward an end of the truss, and webs 13 and 15 extend diagonally downwardly and longitudinally toward an end of the truss. Wooden blocks 17 and 18 interconnect opposite ends of the chord members as shown.

The opposite tab ends of each web are flattened, as by flattening the tubular material at such ends. Thus, web 12 has flattened ends **12*a* and 12*b*, web 13 has flattened ends 13*a* and 13*b*, etc. Further, one flattened end of each web (i.e., ends 12*a* and 13*a* for example) extends proximate the inner side 10*a* of the upper chord member 10, and the other flattened end of each web (i.e., ends 12*b* and 13*b* for example) extends proximate the inner side 11*a* of the lower chord member. In addition, the flattened ends of certain successive webs extend in overlapping relation. For example, the flattened ends 13*a* and 14*a* of the webs 13 and 14 overlap, the flattened ends 15*a* and 16*a* overlap, the flattened ends 12*b* and 13*b* overlap, and the flattened ends 14*b* and 15*b*** overlap.

Figure 2:
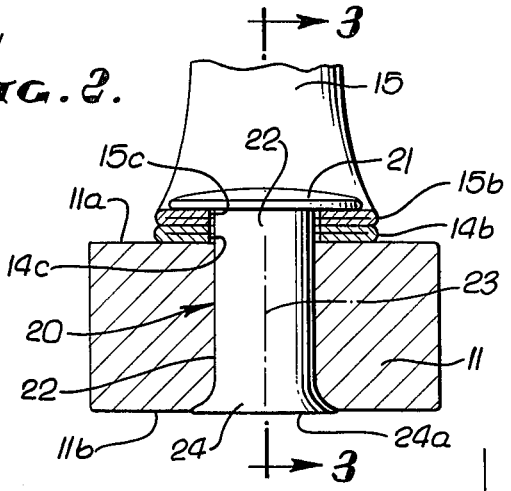
FIG. 2 is an enlarged section on lines 2—2 of FIG. 1.

As further shown in Fig. 2, the overlapping flat ends have aligned openings, as at **14*c* and 15*c***, and this is the case for each pair of overlapping flat ends.

Figure 3:
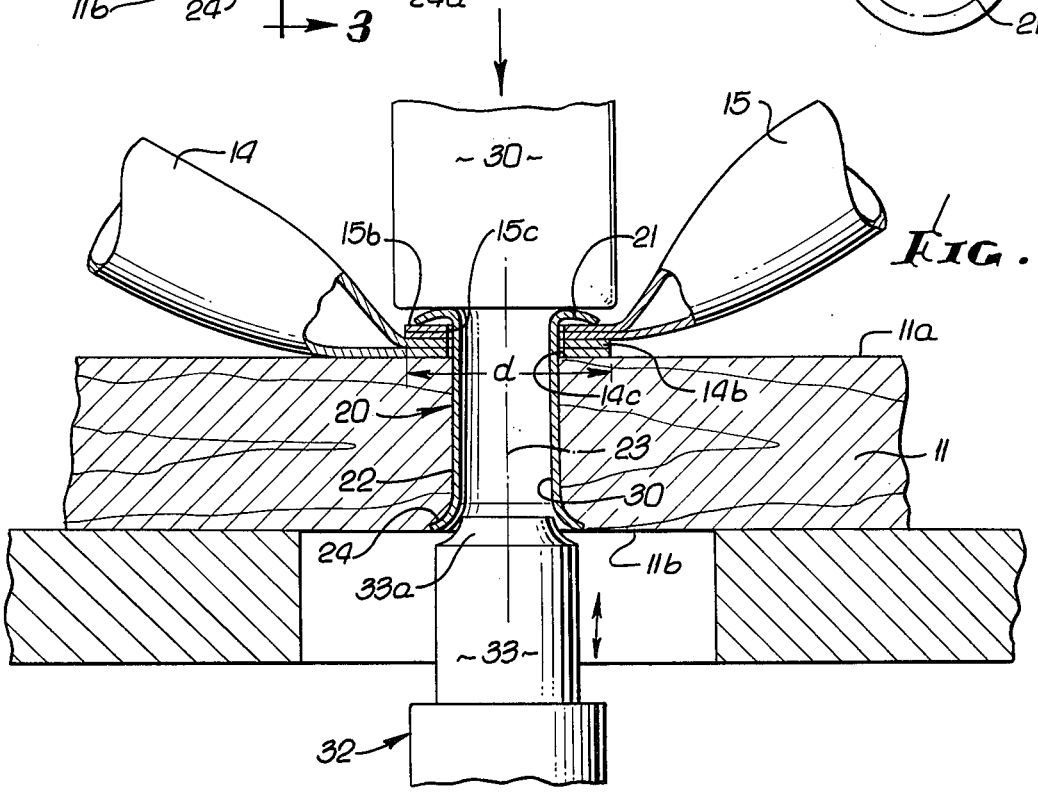
FIG. 3 is a vertical section on lines 3—3 of FIG. 2.

Metallic fasteners are provided to enable rapid and positive attachment of the overlapping ends to the chord members. As shown, each fastener 20 comprises an annular head 21 sized to overlie a flat web end about its opening, and a generally tubular shank 22 to closely extend through that opening. Referring to FIG. 2 and 3, the shank has a longitudinal axis 23 and a flaring end portion 24, the latter being radially outwardly deformed in the chord member 11 to deform and compress the wood immediately adjacent the flare beyond the yield point; further, the end portion 24 terminates at **24*a* in substantially flush relation with the outer surface 11*b* of the chord member. As a result, there is no protruding extent of the fastener beyond surface 11*b*; and the fastener is positively locked against withdrawal from the chord member, whereby the webs are positively maintained in position. Also, the shank 22 is in tension, the web ends 14*b* and 15*b* are maintained in compression by the head 21, and the chord wood adjacent the shank is maintained in compression between the flare 24 and the web ends 14*b* and 15*b*. The head 21** diameter is substantially equal to the length dimensions "*d*" of the web flat ends **14*b* and 15*b***.

The shank 22 is received through the aligned openings **14*c* and 15*c* in the web ends and through bore 30** in the chord member.

The method of constructing the truss basically comprises the steps:

a. forming through openings in the chord members and aligning the web openings with the chord member openings, b. inserting the rivet shanks through the aligned openings bringing the heads adjacent the web end portions when the free ends of the shanks project through the chord openings, and c. deforming the rivet free ends into flaring bell shape thereby locally compressing the chord wood at the outer side of the bell shape, while maintaining the rivet heads adjacent the web end portions.

As explained above, the tubular web ends are preliminarily flattened to have length approximately equal to the rivet or fastener head outer diameters, and openings 30 are preliminarily drilled in the chord members to receive the rivet shanks. Note that web end portions 14*b* and 15*b* are bent relative to the axes of the tubes 14 and 15, the latter thereby extending in a V in FIG. 3 to provide a channel or guide-way therebetween. That channel receives a heavy metal bucking bar 30 (which is confined between webs 14 and 15) in engagement with the rivet head during flare deformation of the rivet end 24. A rivet hammer or driver type tool 32 includes a plunger 33 having a tapered end 33*a* employed to repeatedly impact the shank end, internally, to expand same and form the flare 24, with the bucking bar held against the head 21. Reciprocating plunger type riveting guns are well known; however, their employment for the purposes of the present invention, in the manner described, is of unusual advantage, when provided with tapered ends 33*a* for the purpose described.

Figure 4:
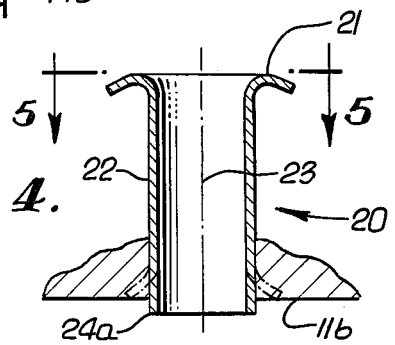
FIG. 4 is an elevation showing the fastener prior to deformation.
Figure 5:
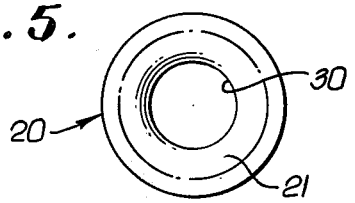
FIG. 5 is a top plan on lines 5—5 of FIG. 4.

Note in FIG. 4 that initially the rivet end portion 24*a* protrudes beyond the chord member outer surface 11*b*; but that after flaring deformation, the rivet end 24 is terminally flush with surface 11*b*, in FIG. 3.

I claim:

1. In a truss, the combination comprising a. upper and lower wooden chord members extending in generally the same longitudinal direction and in spaced apart relation, b. metallic webs extending in zig-zag configuration in the space between the chord members, each web having opposite ends which are generally flat, the flat ends of successive webs extending in overlapping relation and containing aligned openings, and c. metallic fasteners attaching the overlapping ends of the webs to the chord members, each fastener comprising a head overlying a pair of overlapping web ends and a generally tubular shank extending through said openings in said ends, and also through an opening formed in the adjacent chord member, the shank having a bell-shaped flaring end portion which is entirely within the confines of the chord member and radially outwardly deformed in the chord member compressing and deforming the wood adjacent the outer side of the flare, the end portion terminally in substantially flush relation with a surface of the chord member, said flared end portion being at the outerside of the chord member opposite said web flat ends.

2. The combination of claim 1 wherein the webs comprise metal tubes which are locally flattened to provide said flat end portions having rectangular outline.

3. The combination of claim 2 wherein the fastener head is annular and forcibly engages one of the web flat ends, the head diameter being substantially the same as the length dimension of the web flat end engaged by the head.

* * * * *